United States Patent [19]

Mitin et al.

[11] 4,300,802

[45] Nov. 17, 1981

[54] APPARATUS FOR DRIFTING OPENINGS IN HARD ROCK

[76] Inventors: Leonid A. Mitin, Morskoi prospekt, 62, kv. 12; Petr Y. Fadeev, ulitsa Russkaya, 25, kv. 204, both of Novosibirsk; Leonid F. Ponomarev, Zyryanovsky pereulok, 12, kv. 18, Syryanovsk Vostochno-Kazakhstanskoi oblasti; Vladimir Y. Fadeev, ulitsa Tereshkovoi, 6, kv. 180, Novosibirsk; Vyacheslav F. Rybert, ulitsa Zhaksybaeva, 9; Jury V. Reutsky, ulitsa Zhksybaeva, 36, kv. 11, both of Syryanovsk Vostochno-Kazakhstanskoi oblasti; Rim A. Kulagin, ulitsa Tereshkovoi, 2, kv. 22, Novosibirsk; Anatoly A. Vorozheikin, ulitsa Tereshkovoi, 24, kv. 8, Novosibirsk; Nikolai P. Ermilov, ulitsa Rossiiskaya, 12, kv. 56, Novosibirsk; Lidia P. Dimova, ulitsa Pravdy, 5a, kv. 31, Novosibirsk; Adil G. Doskaziev, ulitsa Zhaksybaeva, 13, Syryanovsk Vostochno-Kazakhstanskoi oblasti; Vladlen V. Korobkov, ulitsa Shljuzovaya, 12, kv. 15, Novosibirsk; Sergei A. Babenko, ulitsa 9 Maya, 143b, kv. 93; Mikhail M. Akhmatov, Krasnoarmeisky prospekt 4, kv. 112, both of Tula, all of U.S.S.R.; Nabi K. Zhaksybaev, deceased, late of Alma-Ata, U.S.S.R.; by Ekaterina S. Zhaksybaeva, executrix, ulitsa Pushkina, 50, kv. 3, Alma-Ata, U.S.S.R.

[21] Appl. No.: 92,050

[22] Filed: Nov. 7, 1979

[51] Int. Cl.[3] ..... E21C 29/28

[52] U.S. Cl. ..... 299/64; 173/43; 173/162 R; 299/70; 299/75

[58] Field of Search ..... 299/64, 67, 69, 70, 299/31, 33, 75, 76; 173/139, 162, DIG. 2, 43

[56] References Cited

U.S. PATENT DOCUMENTS

| | | | |
|---|---|---|---|
| 2,654,586 | 10/1953 | Berry | 173/43 X |
| 2,964,305 | 12/1960 | Samhammer et al. | 173/162 X |
| 3,746,104 | 7/1973 | McIntosh et al. | 173/43 |
| 3,958,831 | 5/1976 | Nakashima et al. | 173/43 X |

FOREIGN PATENT DOCUMENTS

| | | | |
|---|---|---|---|
| 631608 | 11/1978 | U.S.S.R. | 173/43 |

*Primary Examiner*—Ernest R. Purser

*Attorney, Agent, or Firm*—Lackenbach, Lilling & Siegel

[57] ABSTRACT

An apparatus for drifting openings in hard rock incorporating a carrier capable for travelling along the floor of the opening. A means of breaking of the percussive type is mounted on the carrier by means of a turnable jib with provision for turning about said jib in a vertical plane. There is also incorporated a means of loading with a mucking conveyor. Employed as the means of breaking with a percussion tool directly acting upon the rock so as to break same when the means of breaking is set into a given position. Also provided are means of shock-absorbing which serve to link up movably said means of breaking with said jib in order to absorb the undesirable deflections of the means of breaking when the percussion tool recoils from the rock at right angles to the longitudinal axis thereof and to return the means of breaking into the given position. The jib also turns about the carrier in a horizontal plane so that the means of breaking can be readily set up in position for breaking any area of the rock face of the drifted opening which is being tunnelled or mined.

8 Claims, 8 Drawing Figures

APPARATUS FOR DRIFTING OPENINGS IN HARD ROCK

The present invention relates to heading machinery with a jib-type operating mechanism acting selectively and, more specifically, to apparatus for drifting openings in hard rock.

It may be used to advantage in mining as a means, for example, of driving openings in hard rock by the percussive method of attacking same.

Another possible field of application of the present invention is construction, as well as mining, where it can be employed in machines with 20 to 200-kJ percussive tools for disintegrating outsize lumps of rock, demolishing foundations and walls of buildings, breaking up concrete road pavement, preparing bed rock foundation for dams and other hydroprojects, etc.

BACKGROUND OF THE INVENTION

There is known an apparatus for drifting openings in hard rock referred to as heading combine (cf. French Pat. No. 2,193,138) incorporating a baseplate, a first carriage mounted on said baseplate, a trough-shaped carrier attached to the first carriage so as to be capable of rotating about the vertical axis, a boom extending parallel to the longitudinal axis of the baseplate and fitted with due regard for rotation on the trough-shaped carrier about the horizontal axis as well as with due regard for rotation about its own longitudinal axis, a turntable fitted to the frame with provision for rotation about the horizontal axis and located at—or contiguous with—the outside end of the boom, a second carriage serving to provide support for an operating mechanism and fitted with provision of sliding relative to the turntable.

Apart from that, the combine is provided with means of mucking comprising a winch and a scraper bucket, the winch being arranged in the wake of the machine—preferrably on the baseplate or linked up with same by means of a rope and sheave—and the scraper bucket working ahead of the combine and being linked up with said winch.

The first carriage is capable of travelling along the baseplate with the aid of double-acting hydraulic jacks.

The trough-shaped carrier is capable of turning on the first carrier to which it is fitted and about the vertical axis through an angle of 45° either side from the longitudinal axis of the machine also with the aid of double-acting hydraulic jacks.

The boom located on the trough-shaped carrier can be turned by a pair of double-acting jacks either through 35° upwards or 10° downwards from the horizontal axis. In addition, the boom can be rotated through 360° about its own longitudinal axis by a mechanism incorporating two hydraulic jacks and a rack and pinion, the pinion being attached to the boom.

The turntable fitted to the front end of the boom is capable of turning with respect to said boom starting from a position parallel to the longitudinal axis thereof and ending in a position at right angles to the same longitudinal axis of the boom, being acted upon by respective double-acting jacks.

The second carriage which is fitted to said turntable and serves to hold fast a means of breaking can be displaced along the longitudinal axis of the turntable by a double-acting hydraulic jack.

All the jacks operate from a hydraulic system incorporating an oil tank, a pump with a motor, piping, and various control and safety valves. The hydraulic system is manually controlled from an operator's seat available on the trough-shaped carrier.

In operation, the means of breaking is fed and its tool is pressed to the rock at the point where this should be broken by the above components of the machine. After that a ram of the means of breaking strikes against the tool transmits the energy of the impact to the rock which is consequently disintegrated. On breaking off a lump of rock, the means of breaking is reset into the working position and the next stroke is applied. The broken rock is removed with the aid of the scraper bucket and winch.

The apparatus for drifting openings in hard rock described above is of a rather complicated construction, featuring numerous hydraulic jacks and pivoted members. The percussive means of breaking used in this apparatus requires careful setting so that its longitudinal axis and the coinciding axis of the tool are essentially at right angles to the solid rock at the point of striking. When a lump of rock falls down after the stroke the tip of the tool interacting with the rock is likely to slip along the surface thereof at an angle with the axis of the means of breaking which is far from being a right one. Said slippage may impose dynamic loads of considerable magnitude on all elements of the apparatus, and—since these loads are limited only by the amount of yielding said elements are capable of—there is the danger of a breakdown.

Obviously, constructional intricacy and the phenomenon of slippage of the breaking tool described above impair the operational dependability of the known apparatus to a considerable extent.

The necessity of setting the means of breaking at right angles to the solid rock each time preparatory to the stroke entails considerable losses of operating time and, consequently, reduces the efficiency of breaking.

Also known is another apparatus for drifting openings in hard rock referred to as hard-rock mining machine (cf. U.S. Pat. No. 3,863,989). It has a manipulator frame extendable in height so as to thrust against the roof and floor of the opening through the intermediary of an upper and a lower means of support, respectively. The manipulator frame carries a percussive means of breaking with a reciprocating rock-crushing tool, said means being fitted to the frame so as to be capable of turning in the horizontal and vertical planes for working on the face systematically over its entire breast.

Linked up with the means of support of the manipulator frame is a means of thrust serving as a carrier with respect to which said frame is capable of moving along the opening integrally with the percussive means of breaking. Said means of thrust is provided with a headpiece and skids extending next to and along the side walls of the opening, said headpiece of the means of thrust and the upper means of support. of the manipulator frame forming a canopy which provides support for the roof.

The manipulator frame, in its turn, incorporates a base plate with vertically-fitted thrust cylinders and a transverse girder with uprights which pass through guide sleeves and rest on the movable parts of the thrust cylinders, including the pistons and piston rods. The guide sleeves are attached to two sidepieces fitted to said base plate.

The percussive means of breaking is fitted to a horizontal shaft supported by bearings in two said side-pieces and capable of rotating in the vertical plane by virtue of a hydraulic cylinder. A spherical joggle provided in the middle of the transverse girder of said manipulator frame engages a spherical recess in the upper means of support so that a pivot joint is formed which links up the manipulator frame with said upper means of support. A drum situated at the bottom of the manipulator frame below the base plate is girdled by a chain the ends of which are connected to a hydraulic cylinder installed on the lower means of support. Said drum, in conjunction with the rest of above mentioned components interacting therewith, serves the purpose of turning the manipulator frame integrally with the percussive means of breaking in the horizontal plane.

Available in the lower end face of the drum is a spherical recess which is engaged by a spherical joggle secured to the lower means of support so that a pivot joint is provided between the base plate of the manipulator frame and the lower means of support.

Said means of thrust is provided with two hydraulic cylinders fitted to the skids so that the movable components of said cylinders provide support for the uprights passing through the guide sleeves which are attached to struts rigidly linked up with the skids. Resting on the spherical heads of said uprights is the headpiece of the means of thrust. The skids are interlinked with each other by a stack of laminate plate springs capable of an elastic deformation thanks to which the skids readily negotiate surface irregularities of the floor when the machine is on the move.

The skids are linked up with the lower means of support of the manipulator frame through the intermediary of two hydraulic cylinders, and another pair of hydraulic cylinders interlinks the upper means of support of the manipulator frame with the headpiece of the means of thrust.

The rock-breaking procedure is as follows. The rock-crushing tool is set to reciprocate, striking at the same point on the face until the rock breaks off within the depth of the layer excavated. After that the means of breaking is turned in either the vertical or horizontal plane so as to be aimed at an adjacent point and the breaking goes on in said sequence of events over the entire face breast. The muck is removed from the working zone by any known means of loading and hauling.

When rock is being broken by the percussive means of breaking, the manipulator frame is held fast due to its means of support which are thrust by the relevent hydraulic cylinders against the roof and floor of the opening. To advance the machine, the means of thrust takes over, its hydraulic cylinders exerting a thrusting action against the roof and floor, while the manipulator frame is relieved of the thrust applied thereto. Next the manipulator frame is advanced with the aid of the hydraulic cylinders interlinking the frame with the means of thrust. Once in a new position, the manipulator frame is again held fast by its thrustable means of support whereas the means of thrust is set free and is dragged into a new position in the wake of the manipulator frame by said hydraulic cylinders interlinking said frame with said means of thrust. Thus, the machine is advanced over the working in accordance with the known principle of walking.

In the described apparatus for drifting openings in hard rock, the operation of the percussive means of breaking sets up high dynamic loads on its components, said loads occurring mainly either after oblique strokes, i.e., those when the percussion tool travels before the stroke over a path deviating from the normal to the surface of rock at the point of impact, or after idle strokes when the tool fails to meet the rock at the end of its travel towards the face. This latter phenomenon is a quite frequent occurence partly observed every third to fifth stroke depending on the conditions, for the rock breaks off in a manner which is a rather irregular one.

In addition to impairing the dependability of the apparatus to a considerable extent, said loads have also an adverse effect on the hydraulic cylinders serving to turn the means of breaking in the course of manipulation in that they trigger safety valves, bring about leaks of fluid from said cylinders and, as a result, cause the means of breaking to miss the point it is necessary to strike at. Said deviations of the means of breaking call for additional manipulation so as to aim at the point and this, in its turn, reduces the efficiency of breaking.

SUMMARY OF THE INVENTION

It is an object of the present invention to enhance both the dependability of the apparatus for drifting openings in hard rock and the efficiency of breaking the rock when said apparatus is used for drifting.

The essence of the invention comprises an apparatus for drifting openings in hard rock incorporating a carrier capable of travelling along the floor of the opening mounted whereon by means of a turnable jib is a means of breaking of the percussive type turnable about said jib in a vertical plane and also incorporating a means of loading with a mucking conveyor. The means of breaking is a means of breaking with a percussion tool directly acting upon the rock so as to break same when the means of breaking is set into a given position and that means of shock-absorbing are provided for which serve to link up movably said means of breaking with the jib in order to absorb the undesirable deflections of the means of breaking when the percussion tool recoils from the rock at right angles to its longitudinal axis and to reset the means of breaking into the given position.

The fact that the means of shock-absorbing are available in the movable line-up of the means of breaking with the jib assures that the intensity of the impact loads the components of the apparatus are subject to due to oblique and idle strokes of the percussion tool is reduced to an allowable level and that the means of breaking is reset into the given position, thereby avoiding the necessity of manipulating with the means of breaking after every stroke against the rock face.

It is expedient that in the apparatus for drifting openings in hard rock the jib is given the shape of a fork and the means of breaking is located between the arms thereof with provision for turning about an axis running substantially through the center of mass of said means of breaking and at right angles to the longitudinal axis of the jib.

By suspending the means of breaking from the axis running through the center of mass thereof the moment of inertia of said means is reduced to a minimum wih the result that the loads the components of the means of breaking are subject to are significantly reduced. At the same time, the forked jib reduces the size of the apparatus and assures fairly wide limits for the manipulation with the means of breaking while working on the face of the driven opening.

It is also expedient that in the apparatus disclosed a frame is fitted between the arms of the jib with provision for turning, said frame surrounding the means of breaking, and the means of shock-absorbing are arranged along the contour of the frame in a uniform way with respect to the longitudinal axis of the means of breaking.

The introduction of an extra component, i.e. the frame, attached whereby is the means of shock-absorbing, into the movable link-up securing the means of breaking between this latter means and the forked jib makes it possible to minimize the number of components taking part in the recoil after an oblique stroke and, consequently, to reduce the moment of inertia of the recoiling components, reducing thereby the dynamic loads the components of the apparatus are subject to.

It is a further expedient that the frame is secured between the arms of the jib so that the axis turnable about which said frame is offset from the center of mass of the percussive means of breaking, is displaced away from the face of the drifted opening.

Said offset of the axis of the frame has a favorable effect on the shape of the breast of the face of the driven opening in that it minimizes the need for manipulation, enhancing thereby the efficiency of breaking.

Yet it is also expedient that in the apparatus disclosed the means of loading with the mucking conveyor is arranged under the jib carrying the means of breaking with provision for displacement relative to the jib with the means of breaking in the direction towards and away from the face of the drifted opening.

The movability of the means of loading enables one of the degrees of freedom to be taken away from the means of breaking so as to impart same to a component which is loaded to a lesser extent that the means of breaking, and simplifying thereby the structural layout of the apparatus and enhancing the dependability thereof.

On the other hand, the ability of the means of loading to move assures the clearing of the face from muck simultaneously with breaking the rock at the top of the breast, for the means of loading can advance into the face immediately after the means of breaking has finished work at the bottom of the breast. This cuts the time wasted in removing the muck from the face and, consequently, enhances the efficiency of breaking.

BRIEF DESCRIPTION OF THE DRAWINGS

A preferred embodiment of the present invention will now be described by way of an example with reference to the accompanying drawings in which.

DESCRIPTION OF THE PREFERRED EMBODIMENTS

Figure 1:
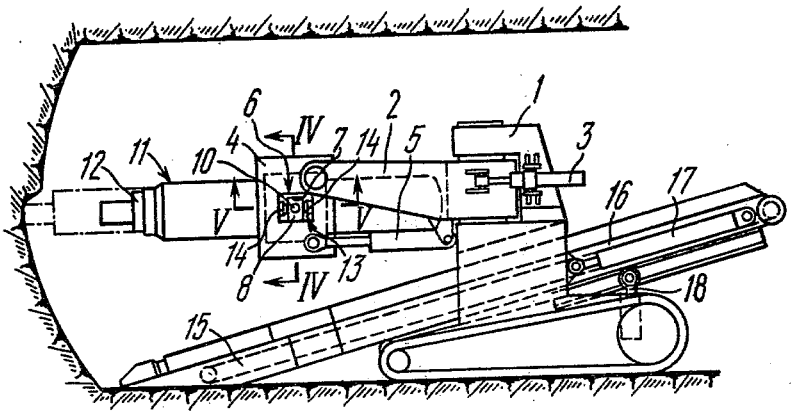
FIG. 1 is a side elevational view of an apparatus for drifting openings in hard rock made in accordance with the invention with a crawler-tracked carrier.
Figure 4:
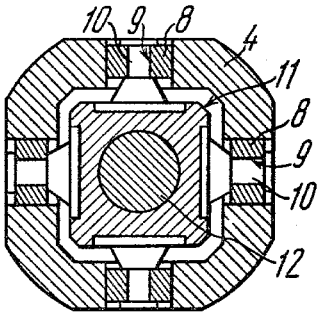
FIG. 4 is a sectional view taken on the line IV—IV of FIG. 1, illustrating the way the means of breaking is secured to the frame.

Referring to FIG. 1, the apparatus for drifting openings in hard rock incorporates a movable carrier 1 capable of travelling along the floor of the opening due to a motive power obtained from any known drive (not shown). Said carrier is the base component secured whereto are the rest of the components of the apparatus. Attached to said carrier 1 by means of substantially a vertical pivot is a jib 2 of forked shape turnable relative to said carrier 1 in essentially a horizontal plane by two hydraulic cylinders 3. Between the arms of said forked jib 2 (FIG. 2) there is held fast a frame 4 turnable relative to the jib 2 in essentially a vertical plane due to the action of two hydraulic cylinders 5 (FIG. 1). The frame 4 has four ports 6 (FIGS. 1,2) piercing its walls, and movably fitting slideways 7 of said ports 6 are sliders 8 with holes 9 (FIG. 4) inserted into which with provision for turning relative to said sliders 8 are fulcrum pins 10 attached whereto is a means of breaking 11. Said fulcrum pins 10 are located so that a common axis of rotation of each pair thereof passes essentially through the center of mass of the means of breaking 11 and is perpendicular to the longitudinal axis thereof. The means of breaking 11 is a high-energy percussive means of breaking of the projectile type (the energy of a single stroke being of the order of several tenths to several hundredths of kJ), i.e., one of the percussion tool 12 which is not in contact with the breast of the face worked before striking a stroke.

The internal arrangement of the means of breaking 11 (FIG. 3) save the particulars pointed out above, is not concerned with the essence of the invention and can be of any kind.

Secured to the abovementioned frame 4 (FIGS. 1,2) symmetrically with respect to a plane which is perpendicular to the longitudinal axis of the means of breaking 11 and passes through the axis of the fulcrum pins 10, there are means of shockabsorbing 13 arranged in two groups so that every said slider 8 is prevented from sliding along the respective slideways 7 by thrusters 14 of said means of shock-absorbing 13, and said thrusters 14 contacting said sliders 8 on either side thereof.

The means of shock-absorbing 13 (FIG. 1) serve the purpose of minimizing the loads the means of breaking 11 (FIG. 4) imposes on the rest of components of the apparatus after an oblique or idle stroke of the percussion tool 12 as well as retaining the given direction of the longitudinal axis of the means of breaking 11 should any of the above phenomena occur. Internally, the means of shock-absorbing can have any arrangement, for this does not impair the essence of the invention.

Figure 5:
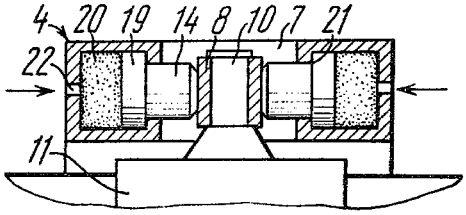
FIG. 5 is a sectional view taken on the line V—V of FIG. 1, illustrating the means of shockabsorbing.

In the preferred embodiment thereof, the means of shock-absorbing incorporates two oppositely located air cylinders the piston rods whereof are the thrusters 14 (FIG. 5) attached to pistons 19 fitting into cylinder bores 20 filled with a compressed gas. If none of the sliders 8 exerts an action, each of the associated thrusters 14 is pressed against the respective front end face 21 of the cylinder bore 20 by the pressure of gas applied to the piston 19.

The compressed gas is admitted into and released from the cylinder bores 20 through openings 22. Suitable for use as the means of shock-absorbing are hydraulic cylinders, springs, rubber elements, etc.

The frame 4 (FIG. 1) is so secured to the jib 2 that the axis of rotation of said frame is offset from the center of mass of the means of breaking 11, being displaced away from the rock face of the driven opening.

On said carrier 1 (FIGS. 1,2,3), under the jib 2 carrying the means of breaking 11, there is arranged a means of loading 15 with a mucking conveyor 16. Said means of loading 15 is capable of displacing relative to the jib 2 with the means of breaking 11 along the longitudinal axis of the apparatus towards and away from the face of the opening driven due to the action of hydraulic cylinders 17 and is also capable of lifting and lowering its front part due to the action of hydraulic cylinders 18 (FIG. 1). In the embodiment of the invention depicted in FIGS. 1, 2, 3, the means of loading 15 is of the type featuring gathering arms and the mucking conveyor 16 is a scraper conveyor. A point to be noted is that a means of loading as well as a conveyor of any other known type can be used in the disclosed apparatus, implying that the above specific materialization of the means of loading neither affects the essence of the invention nor limits the scope thereof.

In addition to the abovementioned components, the apparatus incorporates a power plane supplying the mechanisms and a hydraulic system with piping, safety and control valves assuring the functioning of the hydraulic cylinders the apparatus is fitted with. Said means can be accommodated on the carrier 1 or packaged as a separate unit, and they are not shown in the accompanying drawings.

The fact that the means of breaking 11 (FIG. I) is attached with the aid of the means of shock-absorbing 13 creates the prospect of reducing the loads set up by the oblique and idle strokes of the percussion tool 12 and transmitted from the means of breaking 11 to the rest of components to an allowable and, what is particularly important, readily controllable level. This, in its turn, improves the conditions under which the components of the apparatus are bound to operate and, consequently, adds to the dependability of the apparatus.

Another point is that the continuing resetting of the means of breaking 11 into the given position effected through the intermediary of the means of shock-absorbing after sidewise recoils caused by oblique strokes cuts to a minimum the time wasted in manipulating with the means of breaking 11 and enables all the subsequent strokes to be applied at a point where the rock structure has been disturbed in the course of the preceeding strokes. Said factors provide for enhancing the efficiency of breaking in a significant way.

By virtue of giving the jib 2 the shape of a fork and securing the means of breaking 11 so as to enable it to turn about an axis passing essentially through the center of mass thereof after a sidewise recoil a noticable decrease in the moment of inertia of the means of breaking 11 is obtained with a simultaneous decrease in the loads exposed whereto are the components of the means of breaking and other components of the apparatus linked up directly with said means. It goes without saying that this all has a positive effect on the dependability of the apparatus as a whole.

The inherent feature of assigning different components the function of manipulating and that of absorbing the sidewise recoil materialized through the introduction of the frame 4 simplifies the design of said components on one hand and enables the means of shock-absorbing 13 to cope with absorbing both the sidewise recoil after oblique strokes and the idle strokes of the percussion tool 12 on the other hand so that an enhanced dependability of the structure is the outcome.

The introduction of the frame 4 into the unit serving to attach the means of breaking 11 to the forked jib 2 provides the opportunity of separating the horizontal axis of turning of the means of breaking 11 in the vertical plane in the course of manipulating from the horizontal axis of turning at the instant of a sidewise recoil thereof in the same plane. On the other hand, in the interests of enhancing the efficiency of breaking it is desirable that the face of the opening driven has a minimum area, for the time wasted in manipulating depends among other things on the area of the face worked. The fact that the axis of the frame 4 is offset from the center of mass of the means of breaking 11, being displaced away from the face, is conducive to extending the length of that portion of the means of breaking 11 which consists of the jib. This, in its turn, reduces the area of the face at a given inner diameter of the opening and, consequently, taking into account the aforesaid, contributes to an enchanced efficiency of breaking.

In the light of the fact that the means of loading 15 with the mucking conveyor 16 the apparatus disclosed is provided with is capable of displacing relative to the jib 2 attached whereto is the means of breaking 11 towards and away from the face, there is no need to provide for the mobility of the means of breaking 11 towards and away from the face. The consequence is a simplicity of the suspension of the means of breaking 11 in spite of the fact that said means is subject to sufficiently high impact loads. Another advantage is that the mobile means of loading 15 can remove the broken rock from the face while the means of breaking 11 is at work at the top of the face. This cuts unproductive wastage of working time and again results in an enhanced efficiency of breaking.

The disclosed apparatus for drifting openings in hard rock operates on the following lines.

Figure 6:
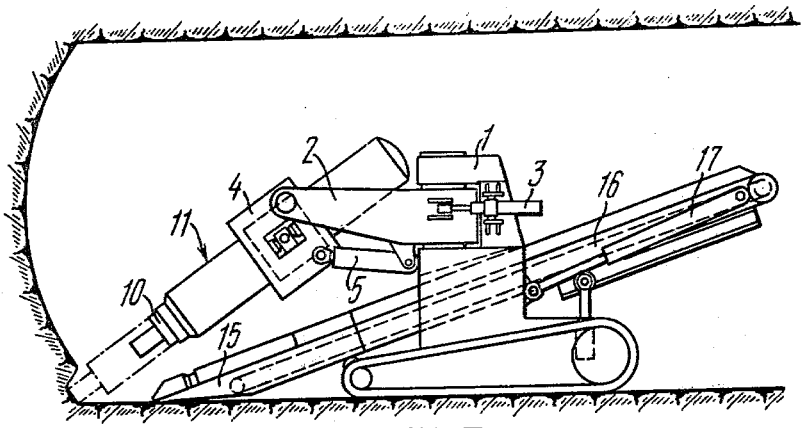
FIG. 6 is a view similar to that of FIG. 1, illustrating a side elevation of the apparatus inclined for working the bottom of the face breast.

The apparatus, travelling along the opening, approaches the face within a certain distance and then the means of loading 15 (FIG. 6) is shifted integrally with the mucking conveyor 16 by the hydraulic cylinders 17 away from the face while the means of breaking 11 is aimed, using the manipulating cylinders 3 and 5, at a point in a lower corner of the face breast. On being set into operation, the means of breaking 11 reciprocates integrally with the percussion tool 12 so that the latter strikes at one point until the rock breaks off to the depth of a layer removed. Next, the means of breaking 11 is aimed at the next point on the horizontal, using the jib-turning hydraulic cylinder 3, and the process of breaking continues. On finishing with the lowermost part of the face breast, the means of breaking 11 is turned vertically by an amount equal to the specified pitch, using the hydraulic cylinders 5, and the means of loading 15 with the mucking conveyor 16 is advanced by the hydraulic cylinders 17 towards the face. After that the means of breaking 11 continues its operation by analogy with the above pattern and operating simultaneously therewith is also the means of loading 15, clearing the face of the muck. When the breaking is completed over the entire face breast, the above cycle is repeated.

When the means of breaking 11 (FIG. 1) is in operation, the bulk of the strokes the percussion tool 12 whereof delivers against the rock face are oblique strokes, i.e., those characterized by a deviation of their path from a normal to the surface of rock at the point of stroke. Every oblique stroke is always accompanied by a sidewise recoil. Said recoil occurring in a horizontal plane causes the means of breaking 11 to pivot about a vertical axis passing through the center of mass thereof on a pair of fulcrum pins 10 turnable in the sliders 8 located above and below the means of breaking 11. At the same time, those sliders 8 which are located at the sides of the means of breaking 11 are acted upon by the fulcrum pins 10 fitting thereinto and consequently slide along the slideways 7, exerting an action on the thrusters 14 of the means of shock-absorbing 13. When the sidewise recoil comes to an end, i.e., the energy of the sidewise recoil of the means of breaking 11 is absorbed by a pair of means of shock-absorbing 13 and the means of breaking 11 ceases to pivot, the means of shock-absorbing reverse the process of pivoting of the means of breaking 11, resetting same into the given position. A sidewise recoil in a vertical plane occurs in an analogous way, the horizontal pair of sliders 8 remaining at standstill and the vertical one displacing in opposite directions. If a sidewise recoil occurs in a plane between the horizontal and vertical one, set into operation are simultaneously the two vertical and the two horizontal means of shock-absorbing 13.

If a stroke the percussion tool 12 of the means of breaking 11 delivers is an idle one either fully or partly, i.e., the percussion tool 12 either misses the rock face or is short of time to utilize the entire energy it possesses for breaking the rock, the means of breaking 11 tends to follow its percussion tool 12 and, consequently, acts upon the thrusters 14 of the forward group of the means of shock-absorbing 13 through the intermediary of its fulcrum pins 10 and the associated sliders 8 said pins fit into. When the means of breaking 11 is brought to a halt, the process is reversed, i.e., the sliders 8 associated with the thrusters 14 of the forward group of the means of shock-absorbing 13 are caused by said thrusters 14 to slide over the slideways 7 in the respective ports 6 of the frame 4 so that the means of breaking 11, urged by the corresponding fulcrum pins 10 to follow said sliders 8, is reset into the given position. Thus, it is possible to limit the loads imposed on the frame 4 and the rest of components of the apparatus by setting the parameters of the means of shock-absorbing 13.

In the preferred embodiment of the invention, any load a thruster 14 (FIG. 5) of the means of shock-absorbing 13 (FIG. 1) is subject to causes said thruster 14 (FIG. 5) to displace inside the cylindrical bore 20 so that the associated piston 19 compresses the compressed gas contained in said bore 20. Any sidewise recoil or idle stroke of the means of breaking 11 is absorbed by the compression of the gas in the respective cylindrical bore 20 of the means of shock-absorbing 13. Acted upon by the compressed gas, the respective thrusters 14 cause the associated sliders 8 to slide over the slideways 7 in the respective ports 6 of the frame 4 and said sliders 7 reset the means of breaking 11 into the given position through the intermediary of the respective fulcrum pins 10.

Taking into account the aforesaid, there are good reasons to claim that the disclosed apparatus for drifting openings in hard rock is not only by far more dependable than other apparatus known before but also displays a much more higher efficiency of breaking.

Figure 7:
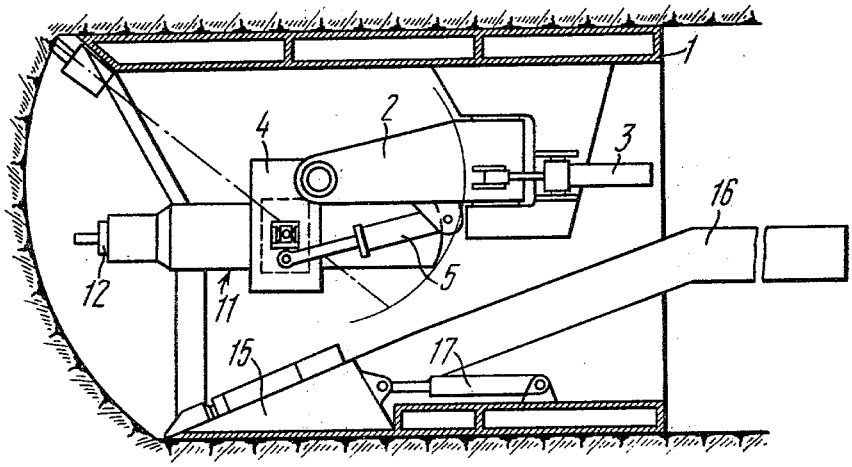
FIG. 7 is a side elevation of another embodiment of the apparatus wherein a tunnelling shield is employed as the carrier, with said shield being shown in a vertical section taken through the longitudinal axis thereof.
Figure 8:
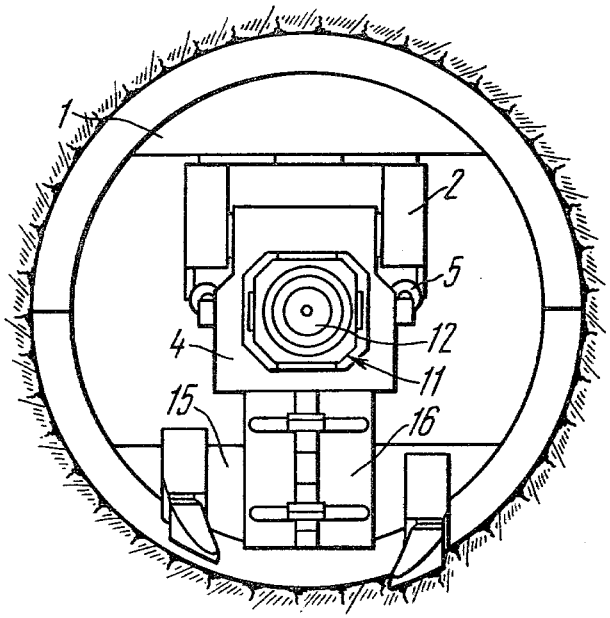
FIG. 8 is a front elevational view of the apparatus shown in FIG. 7.

In another embodiment of the invention, used as the carrier 1 capable of travelling along the floor of the opening is a tunnelling shield. (FIGS. 7,8). Referring to FIG. 7, attached to the carrier I by means of essentially a vertical pivot is the jib 2 of forked shape turnable relative to said carrier 1 in essentially a horizontal plane by the two hydraulic cylinders 3. Between the arms of said jib 2 there is held fast the frame 4 turnable relative to the jib 2 in essentially a vertical plane due to the action of the two hydraulic cylinders 5.

The construction of the frame 4 and the way the means of breaking 11 is secured to said frame in the apparatus illustrated in FIGS. 7 and 8 are the same as in the apparatus depicted in FIGS. 1 through 4.

The frame 4 is so attached to the jib 2 that the axis of rotation of the frame is offset from the center of mass of the means of breaking 11, being displaced away from the face of the opening driven.

On said carrier 1 (FIGS. 7, 8), under the jib 2 carrying the means of breaking II, there is arranged the means of loading 15 with the mucking conveyor 16. Said means of loading 15 is capable of displacing relative to the jib 2 with the means of breaking 11 and along the longitudinal axis of said movable carrier 1 towards and away from the face of the opening driven due to the action of the hydraulic cylinders 17.

The means of loading 15 used in the apparatus illustrated in FIGS. 7 and 8 has gathering arms and the mucking conveyor 16 is of the scraper type. However, a means of loading and a mucking conveyor of any other known kind can be used in the apparatus disclosed, implying that the above specific materialization of the means of loading neither affects the essence of the invention nor limits the scope thereof.

In addition to the abovementioned components, the apparatus shown in FIGS. 7 and 8 also incorporates a power plant supplying the mechanisms and a hydraulic system with piping, safety and control valves assuring the functioning of the hydraulic cylinders the apparatus is provided with. Said components can be accommodated either on the carrier 1 or packaged as a separate unit, and they are not shown in FIGS. 7 and 8.

Figure 2:
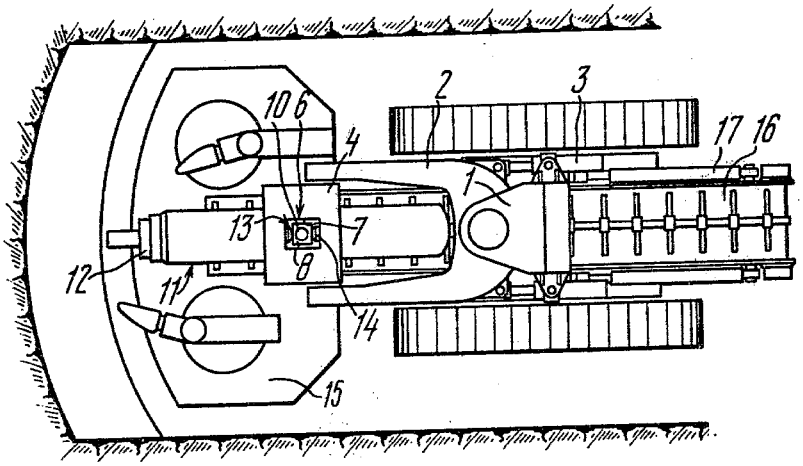
FIG. 2 is a plan view of the apparatus shown in FIG. 1.
Figure 3:
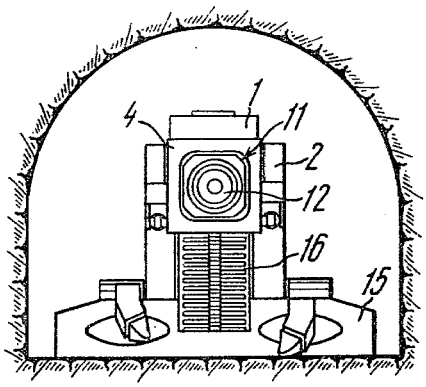
FIG. 3 is a front elevational view of the apparatus shown in FIG. 1.

The apparatus of FIGS. 7 and 8 operates in the same way as the aforesaid apparatus illustrated in FIGS. 1,2,3. The practice of using the apparatus with the means of driving 11 employing a tunnelling shield as the movable carrier 1 is conducive to expanding the field of application of said shield to a considerable extent, rendering it capable of operating in bed rock of extra hardness.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. An apparatus for drifting openings in hard rock comprising:

a carrier capable of travelling along the floor of the opening:

a jib mounted on said carrier with provision for turning about said carrier in the horizontal plane; means for turning said jib with respect to said carrier in the horizontal plane;

a means of breaking of the percussive type with a percussion tool directly acting upon the rock so as to break same when the means of breaking is set into a given position, said means of breaking being mounted on said jib with a provision for turning about said jib in a vertical plane for setting said means of breaking into said given position, and with a provision for limited turning about said jib in two mutually-perpendicular planes running through the longitudinal axes of said means of breaking;

means for turning said means of breaking with respect to said jib in the vertical plane for setting said means of breaking into said given position; shock absorbing means mounted between said jib and said means of breaking and serving to absorb the undesirable deflections of said means of breaking when said percussion tool recoils from the rock in any direction perpendicular to its longitudinal axis and to reset said means of breaking into said given position after the loading action of rock causing said undesirable deflection stops; and a means of loading including a mucking conveyor being arranged on said carrier under said jib.

2. An apparatus as in claim 1, wherein said jib is in the shape of a fork and said means of breaking is located between the arms thereof with a provision for turning about the axes with respect to said jib, said axes running essentially through the center of mass and being perpendicular to the longitudinal axis of said means of breaking.

3. An apparatus as in claim 2, wherein a frame is fitted between said arms of said jib with a provision for turning with respect to said jib in a vertical plane for setting the means of breaking into said given position, said frame surrounding said means of breaking, and said means of shock-absorbing being arranged along the contour of said frame in a uniform way with respect to the longitudinal axis of said means of breaking.

4. An apparatus as in claim 3, wherein said frame is secured between the arms of said jib on a pivot which is offset from the center of mass of said means of breaking, and is displaced away from the face of the drifted opening.

5. An apparatus as in claim 4, wherein said means of loading with said conveyor is arranged under said jib with a provision for displacement with respect to said jib with said means of breaking in the direction towards and away from the face of the drifted opening; and means with a provision for displacement of said means of loading with said conveyor in the direction towards and away from the face of the drifted opening.

6. An apparatus as in claim 3, wherein said shock-absorbing means including pairs of oppositely disposed air cylinders, with the piston rods of same being thrusters attached to pistons fitting into cylinder bores filled with a compressed gas, and said compressed gas pressing said pistons and said piston rods and thrusters against sliders and fulcrum pins of said means of breaking when none of said sliders exerts an action against said thrusters.

7. An apparatus as in claim 3, wherein said shock-absorbing means including pairs of oppositely disposed biasing means bearing against sliders and fulcrum pairs of said means of breaking movably inserted in said sliders.

8. An apparatus as in claim 1, wherein said means of loading with said conveyor is arranged under said jib with a provision for displacement with respect to said jib with said means of breaking in the direction towards and away from the face of the drifted opening; and means with a provision for displacement of said means of loading with said conveyor in the direction towards and away from the face of the drifted opening.

* * * * *